United States Patent [19]

Clifford

[11] Patent Number: 4,483,068

[45] Date of Patent: Nov. 20, 1984

[54] RAZORS, RAZOR BLADES AND RAZOR BLADE DISPENSERS

[75] Inventor: Glynne F. Clifford, Staines, England

[73] Assignee: Wilkinson Sword Limited, England

[21] Appl. No.: 324,896

[22] PCT Filed: Apr. 28, 1981

[86] PCT No.: PCT/GB81/00075

§ 371 Date: Nov. 25, 1981

§ 102(e) Date: Nov. 25, 1981

[87] PCT Pub. No.: WO81/03141

PCT Pub. Date: Nov. 12, 1981

[30] Foreign Application Priority Data

Apr. 30, 1980 [GB] United Kingdom ..... 8014233

[51] Int. Cl.[3] ..... B26B 21/14

[52] U.S. Cl. ..... 30/49; 30/64; 30/346.61

[58] Field of Search ..... 30/32, 49, 62, 64, 346.51, 30/346.55, 346.61

[56] References Cited

U.S. PATENT DOCUMENTS

| | | | |
|---|---|---|---|
| 2,342,161 | 2/1944 | Muros et al. | 30/64 |
| 2,439,909 | 4/1948 | Rusican . | |
| 2,686,966 | 8/1954 | Landwehr | 30/64 |
| 2,989,804 | 6/1961 | Yellon | 30/32 |
| 3,130,609 | 4/1964 | Wahl . | |
| 3,494,032 | 2/1970 | Welsh . | |
| 3,702,026 | 11/1972 | Scholin | 30/49 |
| 3,835,532 | 9/1974 | Petrillo | 30/40.2 |
| 3,900,636 | 8/1973 | Curry et al. | 30/346.55 |

FOREIGN PATENT DOCUMENTS

| | | | |
|---|---|---|---|
| 1005977 | 3/1977 | Canada | 30/32 |
| 1134883 | 11/1968 | United Kingdom . | |

OTHER PUBLICATIONS

Canadian Pat. Off. Record, vol. LXIV, No. 15, Apr. 14, 1936, pp. 715–716.

*Primary Examiner*—E. R. Kazenske
*Assistant Examiner*—Douglas D. Watts
*Attorney, Agent, or Firm*—John K. Williamson

[57] ABSTRACT

The invention provides the combination of a razor blade 10 and holder 12 for the razor blade, wherein the cutting edges of the blade are constituted by the periphery of a number of holes 10*b* in the blade, and the holder is provided with means 13 by which the blade can be picked up from a razor blade dispenser 16, the holder maintaining the picked-up blade in an arched condition for shaving. The dispenser may have at least one compartment in which an unused blade 10 can be retained in an arched condition whereby parallel sides of the blade can be engaged by the holder 12 which increases the flexure of the blade to release it from the compartment.

5 Claims, 11 Drawing Figures

RAZORS, RAZOR BLADES AND RAZOR BLADE DISPENSERS

This invention relates to razors, razor blades, and razor blade dispensers.

More particularly the invention relates to razors for use with razor blades which are in the form of a metal foil which has a number of holes therein, the periphery of each hole constituting a cutting edge. The invention also relates to dispensers in which replacement blades of the kind described are stored prior to use and to which used blades may be returned.

Figure 1:
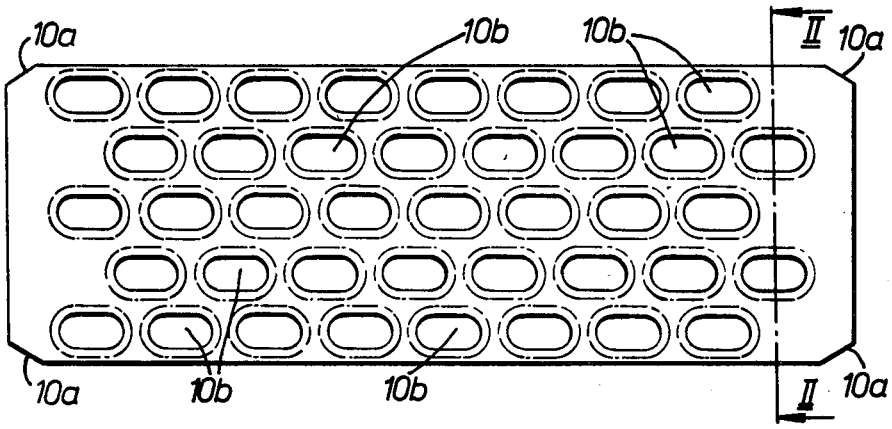
Figure 2:
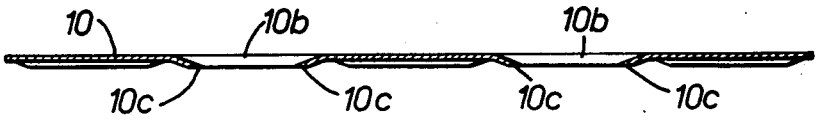
Figure 3:
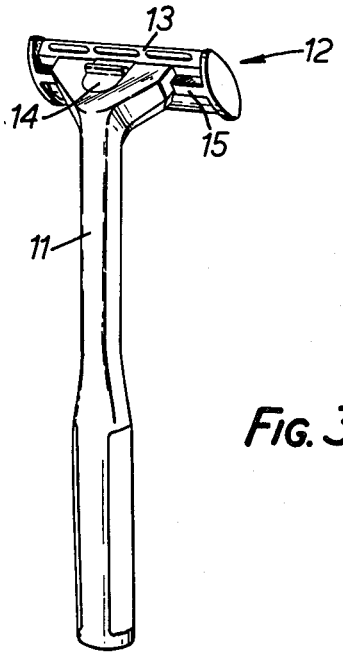
Figure 4:
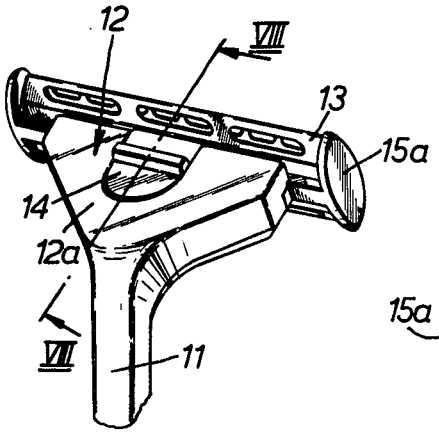
Figure 5:
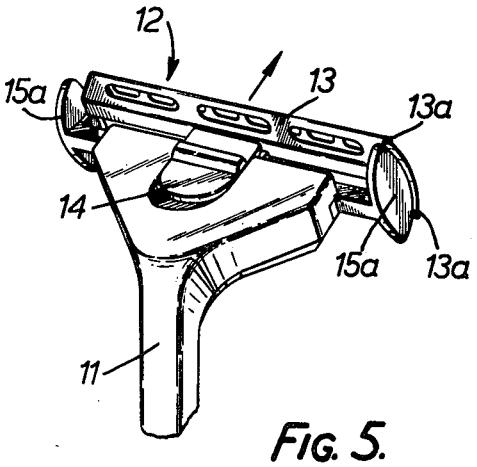
Figure 7:
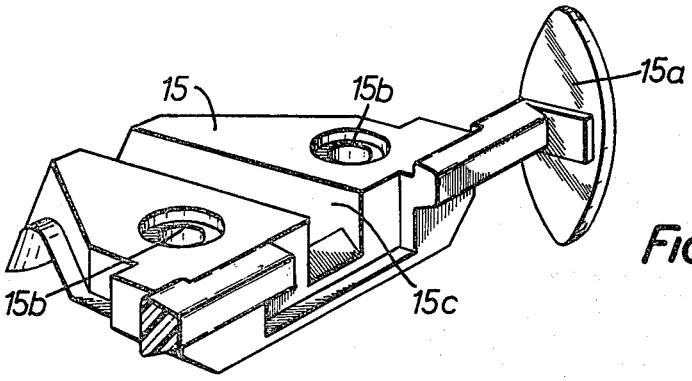
Figure 6:
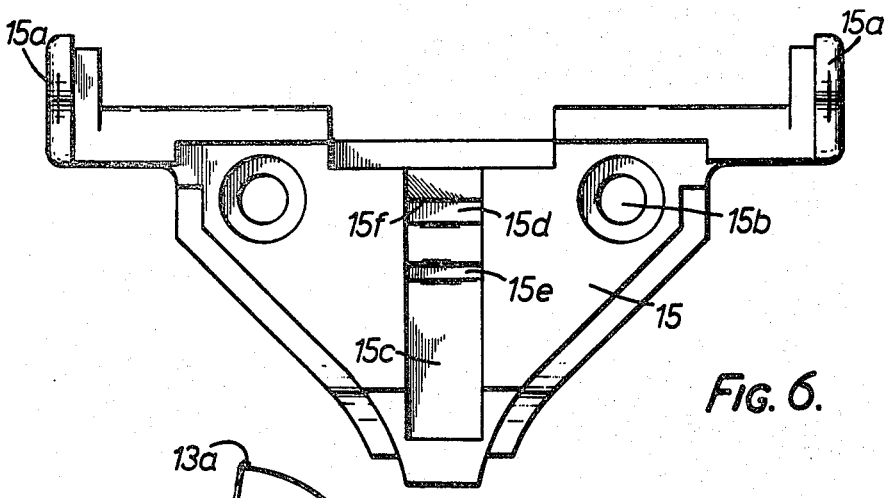
Figure 8:
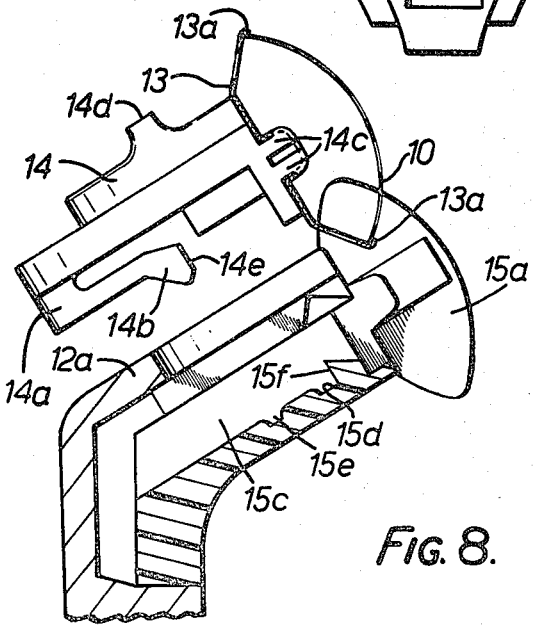
Figure 9:
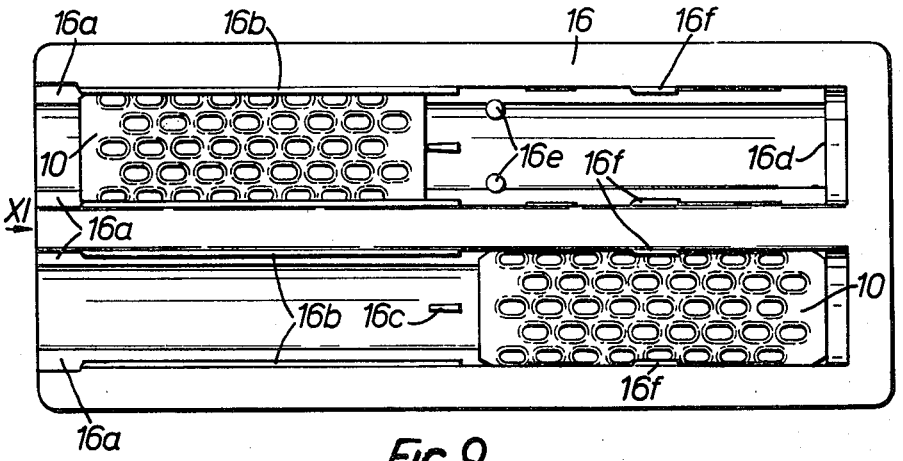
Figure 10:
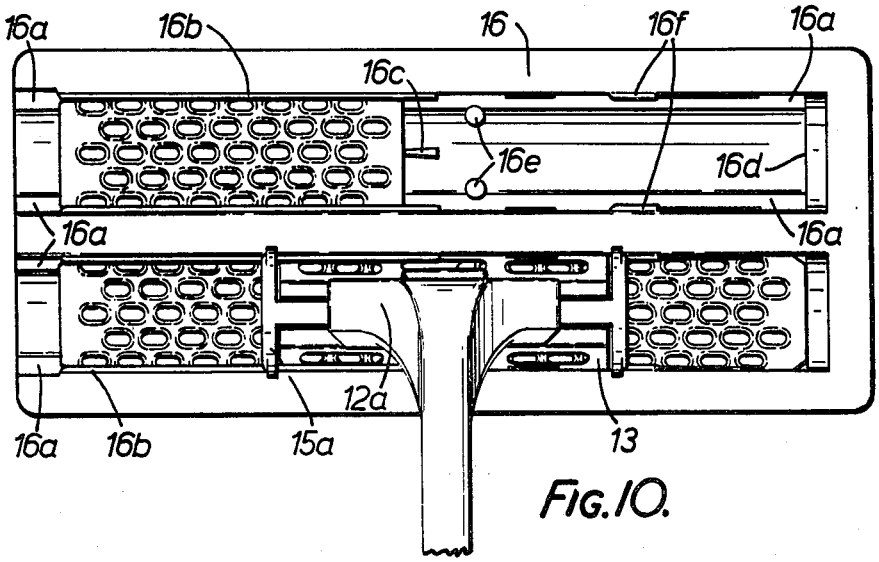
Figure 11:
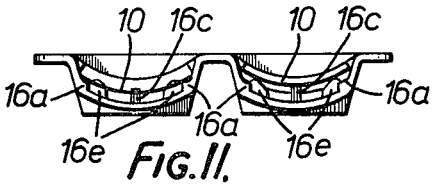

The invention will be better understood from the following description of one construction of razor, razor blade and dispenser in accordance with the invention, which will be described, by way of example only, with reference to the accompanying drawings in which:

FIG. 1 is a plan view of a razor blade in accordance with the invention,

FIG. 2 is a sectional view taken on the line II—II in FIG. 1, on an enlarged scale, FIG. 3 is a rear perspective view of the razor, FIG. 4 is a similar view to FIG. 3 but of the head and upper end of the handle only and on an enlarged scale, showing the razor in the shaving position, FIG. 5 is a similar view to FIG. 4 but showing the razor in the blade changing position, FIG. 6 is a plan view of a moulding which forms a part of the head of the razor, FIG. 7 is a front perspective view of a part only of the moulding shown in FIG. 6, FIG. 8 is a sectional side elevation of the head of the razor taken on the line VIII—VIII in FIG. 4 but with a sub-assembly of an operating button and the blade carrier shown separately above the rest of the head, FIG. 9 is a plan view of the dispenser showing one used blade in the left hand end of one compartment and an unused blade in the right hand end of the other compartment, FIG. 10 is a similar view to FIG. 9, but with the additional of the head of the razor in a position in which a left handed person, holding the dispenser in their right hand, and the razor in their left hand, has returned a used blade to the left hand end of one compartment and is in process of picking up an unused blade from the right hand end of the same compartment, and FIG. 11 is an end elevational view of the dispenser in the direction of the arrow XI in FIG. 9.

Referring first to FIGS. 1 and 2 it will be seen that the foil blade 10 of the present embodiment is of generally rectangular form with cut-away corners 10*a*, and that it has five lines of holes 10*b* of elongated shape with rounded ends, each line consisting of eight holes 10*b*. The periphery region of each hole 10*b* is deformed out of the plane of the blade, as can be seen in FIG. 2, and the periphery is sharpened to form a cutting edge 10*c*, the tip of which has chord widths comparable to those of conventional razor blades. Preferably the blades 10 are of a stainless steel alloy and the holes 10*b* are formed by an initial pierce and form operation followed by hardening and grinding to form a rough cutting edge which is finished by an electrolytic reducing process. The facets of the cutting edges 10*c* are given a coating of polytetrafluoroethylene.

Referring now to FIGS. 3, 4 and 5, in particular, these show the razor which comprises a handle 11 which at its upper end has a head 12 designed to carry the blades. In use, a blade 10 is held by engagement of its two longer edges in a track formed by opposing inwardly-directed flanges 13*a* (FIGS. 5 and 8) of a metal carrier 13. The distance between the flanges 13*a* is such that the blade 10 is arched with the cutting edges 10*c* directed outwardly. In use, the razor will normally be moved to and fro across the skin in a direction parallel to the shorter edge of the blade. However, the blade 10 will also shave whilst being moved in any other direction across the skin, due to the fact that the complete periphery of each hole 10*b* is in the form of the cutting edge 10*c*.

The displacement of the centres of the holes 10*b* relative to one another in alternate lines, serves to ensure that when the blade 10 is moved across the skin in a direction parallel to its shorter edge hairs not cut because of the land between holes 10*b* in one row will be cut by the hole 10*b* in the next row, which is in line with the land in the preceding row. The effective shaving angle of the longer sides of each hole of any cutting edge 10*c* is determined by the angle of the bisector of the facets, by the curvature imparted to the blade when held between the flanges 13*a*, and by the distance between the longer sides of each hole.

The blade carrier 13 is designed to be selectively movable by a thumb button 14 between two positions relative to the remainder of the head 12 of the razor. These two positions are shown in FIGS. 4 and 5, the "shaving position" being shown in FIG. 4 and the "loading position" being shown in FIG. 5. The "shaving position" is that in which the razor is used for shaving, and the carrier 13 is only moved forward to the "loading position" when it is desired to replace the blade 10.

The razor head 12 comprises a cowl 12*a* to the underside of which is fitted a plastic moulding 15, FIGS. 6 and 7, which has ears 15*a* at each extremity adjacent each end of the carrier 13. In the shaving position the ears 15*a* cover the respective ends of the blade 10 to protect the user against any inadvertent cutting or discomfort which might result from the engagement of the ends of the blade 10 with the skin of the user.

The moulding 15 is secured to the underside of the cowl 12*a* by two screws (not shown) which pass through holes 15*b* in the moulding into screw-threaded blind holes (not shown) in the underside of the cowl 12*a*. The moulding 15 has a central slideway 15*c* in which a depending flexible tongue 14*a* of the button 14 is a sliding fit, the tip 14*b* of the tongue 14*a* being engageable in a forward slot 15*d* or a rearward slot 15*e* in the base of the slide 15*c*. The carrier 13 is secured to the button 14 by forwardly extending projections 14*c* which extend through an aperture in the carrier 13. The tongue 14*a* is resilient and its tip 14*b* is bevelled. The edges of the slot 15*e* and the rear edge of slot 15*d* are rounded and by forward pressure on the ledge 14*d* the button 14 can be moved forward with the tip 14*b* of the tongue 14*a* lifting out of the slot 15*e* and stopping when it enters the slot 15*d* and its forwardly directed face 14*e* engages the face of an abutment 15*f* in the slideway 15*c*. The carrier 13 is then in the loading position shown in FIG. 5.

A used blade is replaced with the carrier 13 in the loading position, the carrier 13 being brought into engagement with the dispenser 16 at the open end and opposite a compartment where there is no blade 10 in the section of the compartment adjacent the open end (in the condition shown in FIG. 9 this would be the lower left-hand compartment). The razor head is moved across the dispenser (in a direction from left to right as seen in the drawings) with the carrier 13 adjacent the bottom of the trough in the dispenser. The carrier 13 is located by seating on ledges 16*a*, 16*a* in the walls of the dispenser and by passing under pairs of guide-rails 16*b*, 16*b*, formed in the walls of the dispenser. With further transverse movement of the razor relative to the dispenser the right hand end of the blade 10 meets a stop 16*c* upstanding from the base of the dispenser and this stop 16*c* prevent further movement of the blade 10 into the dispenser. Continuing movement of the holder brings the flanges 13*a* of the carrier 13 into engagement with the unused blade so that, as shown in FIG. 10, continuing movement of the holder progressively releases the used blade from the flanges 13*a* whilst the latter engage the unused blade. Eventually, further movement of the holder is prevented by engagement of the end of the flanges 13*a* with the end wall 16*d* of the dispenser and in this position the unused blade is fully engaged in the carrier 13. The used blade partly unflexes from its arched condition as it is freed from the flanges 13*a* and is trapped under the guide-rails 16*b*, 16*b*. The blade 10, held by the carrier 13, is then released from the dispenser 16 by a tilting movement of the handle 11, the carrier 13 being released from under catches 16*f*, 16*f* as a result of the limited flexibility of the dispenser resulting from the relatively thin plastic material of which it is composed. The cut-away corners 10*a* at the end of a blade facilitate entry into the tract formed by the flanges 13*a*. Additionally, the end of the unused blade is lifted a short distance off the ledges 16*a*, 16*a* by pips 16*e*, 16*e* (as can be seen in FIG. 11) to allow the ends of the flanges 13*a* to pass under the end of the blade. The blade can then be moved into the shaving position by rearward movement of the button 14.

As can be seen in FIG. 10, the width of the ears 15*a* is greater than the width of the compartments in the dispenser 16. Consequently it is not possible for the blade carrier 13 inadvertently to move to the shaving position by downward pressure on the razor during loading and unloading.

It will be appreciated that although the dispenser illustrated is designed to hold two unused blades in the sections at one end and to have deposited therein, in due course, used blades in the other sections, any desired number of compartments can be provided. Moreover, other mechanisms than that described can be used for moving the head into the loading position.

I claim:

1. The combination of a razor blade and holder for the razor blade, wherein said blade comprises a generally rectangular foil having a plurality of holes extending therethrough, the peripheries of said holes forming cutting edges in the blade and the holder is provided with means by which the blade can be picked up from a razor blade dispenser, said means including a blade receiving track formed by a spaced pair of inwardly directed flanges adapted to engage opposite sides of the blade, the spacing between said flanges being less than the distance between said sides when said blade is unrestrained, whereby said blade is maintained in a convexly flexed condition for shaving, wherein the holder has means for covering each end of said track when a blade is held in said track, whereby each end of the blade is shielded from engagement with the skin of the user, and wherein the means on the holder for picking up a blade is movable relative to the handle of the holder between a blade pick-up position at which the ends of said track are uncovered and a shaving position at which said ends are covered.

2. The combination according to claim 1, wherein the blade has a plurality of lines of said holes.

3. The combination according to claim 2, wherein the holes in alternate lines are staggered relative to one another.

4. The combination according to claim 3, wherein the periphery of a hole is deformed out of the plane of the blade.

5. The combination according to claim 3, wherein at least the finishing of the formation of the cutting edges is by an electrolytic process.

* * * * *